United States Patent [19]

Nakatani et al.

[11] 4,234,773

[45] Nov. 18, 1980

[54] DISPLAY DEVICE FOR A PUSH BUTTON ASSEMBLY

[75] Inventors: Kiyotaka Nakatani; Kunikazu Konno, both of Isezaki, Japan

[73] Assignee: Hosiden Electronics Co., Ltd., Japan

[21] Appl. No.: 35,566

[22] Filed: May 3, 1979

[30] Foreign Application Priority Data

May 15, 1978 [JP] Japan ..... 53-65399[U]
Aug. 3, 1978 [JP] Japan ..... 53-107087[U]

[51] Int. Cl.[3] ..... H01H 9/00; H01H 9/16

[52] U.S. Cl. ..... 200/308; 116/279

[58] Field of Search ..... 200/308, 309; 116/279, 116/DIG. 28

[56] References Cited

U.S. PATENT DOCUMENTS

| | | | |
|---|---|---|---|
| 3,715,548 | 2/1973 | Schadow | 200/308 X |
| 3,845,736 | 11/1974 | Golbeck et al. | 116/279 |
| 3,855,961 | 12/1974 | Schadow | 200/308 X |
| 4,031,849 | 6/1977 | Mehta | 200/309 X |
| 4,044,213 | 8/1977 | Kinney | 200/308 |

*Primary Examiner*—Steven M. Pollard
*Attorney, Agent, or Firm*—Steele, Gould & Fried

[57] ABSTRACT

The present invention discloses a display device for a push button assembly having, within a push button provided in the front surface thereof with a window, shutters and a display plate of which display surface is faced to said window.

Inserted into said push button is a support axially movable in a manner relative with the push button. The shutters are not pivoted to the push button, but pivoted to the support. The push button is provided with guide grooves for guiding the pivotal movement of the shutters. While being guided by the guide grooves and responsive to the axial relative movement of the support with the push button, the shutters are rotated between two positions, namely a first position where the display surface is screened from the window and a second position where the display surface is exposed to the window.

9 Claims, 6 Drawing Figures

DISPLAY DEVICE FOR A PUSH BUTTON ASSEMBLY

BACKGROUND OF THE INVENTION

The present invention relates to a display device for a push button assembly in which a window is disposed at the push button and a display surface is disposed oppositely to and inside with respect to this window, whereby the operating state of the push button is displayed on the window by opening or closing shutters disposed between the display surface and the window.

There has conventionally been known a display device of this kind, for example, as disclosed in the U.S. Pat. No. 3,715,548 where the display member is disposed in the push button having a window such that the display surface of the display member is faced to the window, and the covering shutters are disposed between the window and the display surface, said covering shutters adapted to swing, responsively to the axial relative movement of the push button with the display member, between two positions, i.e., a first position where the display surface is screened from the window and a second position where the display surface is exposed to the window.

In such a conventional one, however, the covering shutters are rotatably pivoted in the push button and are adapted to open and close by means of the display member which is adapted to move forward and rearward with respect to the push button. It has therefore been necessary to assemble the shutters in the narrow and small push button housing in a skilful manner such that the shutters be smoothly rotated therein. This presents a problem of being cumbersome in assembly and time-consuming.

Since, in a display device of this kind, the shutters are opened and closed between the window of the push button and the display surface, it may be proposed that, for example, a photo-electric converting element connected to the automatic brightness control circuit of a television set is disposed at the display surface and the automatic brightness control circuit is arranged so as to operate only when the photo-electric converting element is exposed to the window by opening the shutters.

In a conventional display device, however, a pair of shutters are merely disposed in the double-leafed hinged manner and a clearance may therefore be produced easily between the abutted ends of the shutters, thus provoking a possibility of light penetrating the inside of the push button even if the shutters are closed. This therefore presents a problem that it is difficult to permit the automatic brightness control circuit to be operable by applying light onto the photo-electric converting element only when the shutters are opened with the push button depressed.

SUMMARY AND OBJECTS OF THE INVENTION

It is an object of the present invention to provide a display device for a push button assembly which does not require much labour in assembly, particularly in assembly of the shutters.

It is another object of the present invention to provide a display device for a push button assembly in which the shutters may securely be closed without any clearance therebetween.

In order to achieve such objects, the push button in accordance with the present invention comprises a button outer body having a window in the front surface thereof and a button inner body fitted to the bottom opening of the button outer body, and guide grooves are formed between the button outer body and the button inner body in the opposite inner lateral sides of the button outer body.

A display plate is housed in this push button with its display surface faced to the window and a support passing through the button inner body is inserted into the push button. Shutters are rotatably mounted to the support. With the pivoted ends of these shutters guided in the guide grooves, these shutters are adapted to rotate between two positions, i.e., a first position where the display surface is screened from the window and a second position where the display surface is exposed to the window, responsively to the axial relative movements of the push button and the support.

According to the present invention, the push button may be assembled in such a way that the support is inserted into the button inner body and the shutters are pivotally mounted to the support and such assembly is then inserted into the button outer body. The guide grooves for guiding the shutters may be formed between the button outer body and the button inner body at the time when the button inner body is fitted into the button outer body.

It is therefore possible to simplify the assembling work to a great extent as compared with a conventional display device in which the display member should be housed in the push button after the shutters have rotatably been disposed in the narrow and small push button housing.

In order to achieve the objects above-mentioned, the display device for a push button assembly according to the present invention further comprises a pair of shutters and each of the pair of shutters is formed in the jaws shape, such that its lateral sides project rearwardly from the both ends of its display portion adapted to cover each half of said display surface, and pins to be pivoted to the support are disposed at the rear ends of the both lateral sides of each shutter and driven pins to be fittingly inserted into guide grooves are disposed at the front ends of the both lateral sides of each shutter.

The button inner body of the push button is securely fixed to the operational rod of the push button assembly. The support is provided with two leg members in parallel with each other which are slidably moved in the button inner body, and the externally projecting ends of these leg members are secured to the frame of the push button assembly. These leg members are provided with springs expandable in the moving direction of the push button, and these springs are adapted to apply spring-load in the shutter closing direction, to the shutters at their closed position.

According to the present invention, since the shutters are opened and closed in the jaws form, no clearance may be produced between these shutters only if the shutters are closed up to the predetermined position where both shutters become in contact with each other.

Moreover, since the springs disposed at the leg members of the support are adapted to apply spring-load in the shutter closing direction, to the shutters at their closed position, it is possible to forcibly close the shutters to the predetermined closed position and to maintain the shutters as closed by spring-load of the springs, even though the operational rod for supporting the push button is not always projected by a predetermined amount. Therefore, there is not such inconvenience that light penetrates toward the display surface even if the shutters are closed.

In utilizing such characteristic that the shutters can be securely closed without any clearance therebetween, it is possible to dispose at the display surface a photo-electric converting element connected to the automatic brightness control circuit of a television set. In such arrangement, no light penetrates toward the display surface when the shutters are closed, and it is therefore possible to automatically control the brightness control circuit by applying light to the photo-electric converting element only when the shutters are opened.

Furthermore, when the photo-electric converting element is disposed at the display surface, the lead wires from this photo-electric converting element may be extended to the outside of the push button along the leg members of the support and thus extended portions of the lead wires may be entwined with and fixed to the springs disposed at the leg members, thus advantageously eliminating particular component parts for fixing the lead wires.

BRIEF DESCRIPTION OF THE DRAWINGS

The present invention will be further described by way of example, with reference to the accompanying drawings, in which.

DESCRIPTION OF THE PREFERRED EMBODIMENTS

Figure 1:
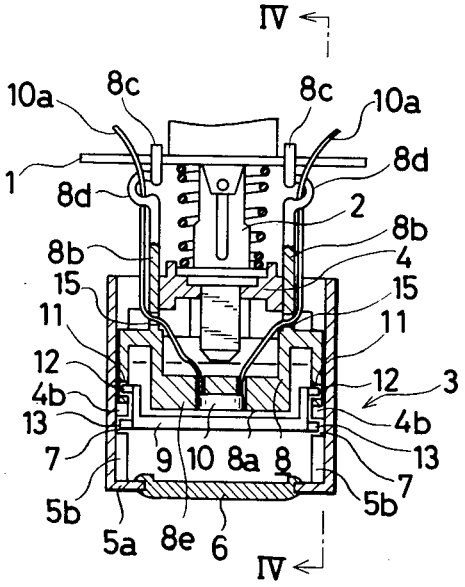
FIG. 1 is a section view of main portions of a display device for a push button assembly according to the present invention.
Figure 2:
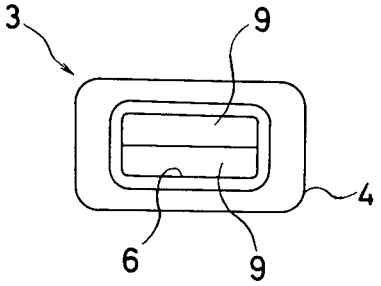
FIG. 2 is a plan view of the present invention with the shutters closed.
Figure 3:
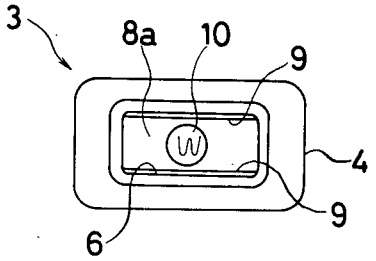
FIG. 3 is a plan view of the present invention with the shutters opened.

In FIG. 1, a frame 1 of a push switch or push button switch assembly provided with a heart cam is fixed to a predetermined member. An operational rod 2 is outwardly projected from the frame 1, and a push button 3 is attached to the tip of this operational rod 2.

The push button switch assembly above-mentioned is of the type well known per se in which, when depressed, the operational rod 2 is locked as pressed by a predetermined amount by means of the heart cam, and when depressed again, the operational rod 2 is released from the locked state and switched to the outwardly projecting state. The change-over contact is wired to open and close the automatic brightness control circuit of a television set.

The push button 3 comprises a button inner body 4 and a button outer body 5 fitted thereto. The button inner body 4 is a block press-inserted into and fixed to the tip of the operational rod 2. This button inner body 4 is provided at the front four corners thereof with projections 4*b* having a rectangular section which are forwardly projected in parallel with each other. This button inner body 4 is further provided in the lateral sides thereof with lateral grooves 4*c* in parallel with the operational rod 2.

The button outer body 5 is formed in the case shape and is provided in the front wall 5*a* with a display window 6. The button outer body 5 is fitted and secured to the outer periphery of the button inner body 4, with the display window 6 oppositely disposed to the front of the button inner body 4. The button outer body 5 is provided at the inner four corners of the front wall 5*a* thereof with projections 5*b* having a section identical with that of the projections 4*b* of the button inner body 4, these projections 5*b* being provided in a unitary construction with the front wall 5*a*.

Slender guide grooves 7 are formed between the rear end surfaces of these projections 5*b* and the front end surfaces of the projections 4*b* in the direction at right angle to the depressed or projected direction of the operational rod 2.

A support 8 is further disposed between the front wall 5*a* of the button outer body 5 and the front surface of the button inner body 4. The support 8 comprises a front display surface 8*a* facing to the display window 6 and a display plate 8*e* in the square pillar shape which is disposed between the front ends of a pair of leg members 8*b* in a unitary construction therewith. The leg members 8*b* are slidably guided into the lateral grooves 4*c* of the button inner body 4 and are hooked to the frame 1 by the hooks 8*c* formed at the tips of the leg members 8*b*. These leg members 8*b* are formed of synthetic resin having a good elastically deforming property. Loop shaped springs 8*d* are formed adjacent these hooks 8*c*, so that the leg members 8*b* may be extended or contracted in the depressed or projected direction of the push-button 3.

A pair of shutters 9 in the jaws form are disposed in front of the display surface 8*a* of the display plate 8*e* disposed at the support 8. One of the pair of shutters 9 is formed substantially in the C shape with their lateral sides 9*b* in the right-angle triangle shape projecting rearwardly in parallel with each other from the both ends of its display portion 9*a* adapted to cover the upper portion of the display surface 8*a*. The rear ends of these lateral sides 9*b* are pivoted, by pins 12 to slots 11 defined in the front ends of the both leg members 8*b* of the support 8.

Driven pins 13 are laterally extended from the pivoted portions or the front top ends of the lateral sides 9*b* and are fitted into the corresponding grooves or the upper guide grooves 7 in a vertically slidable manner.

The other of the pair of shutters 9 is vertically symmetric with respect to said one of the pair of shutters 9, and is adapted to cover the lower portion of the display surface 8*a*.

On the front surfaces of the display portions 9*a* of the shutters 9, there is an indication that the automatic brightness control circuit is OFF, and a photo-electric converting element, for example, a photo-register 10 which serves as a detector of the automatic brightness control circuit, may be attached to the display surface 8*a* of the display plate 8*e*. Lead wires 10*a* of this photo-register 10 are extended to the outside of the push-button 3, for example, through bores 15 defined in the leg members 8*b* of the support 8 and through the lateral grooves 4*c* of the button inner body 4, and are then introduced toward the frame 1 through the springs 8*d* of the leg members 8*b*.

The description will then be made of the operation of the display device according to the present invention.

Figure 4:
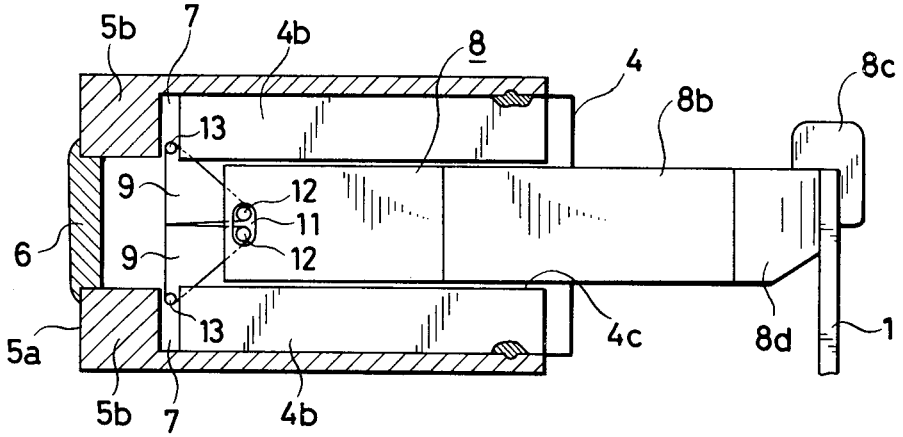
FIG. 4 is a section view taken along the line IV—IV in FIG. 1.
Figure 5:
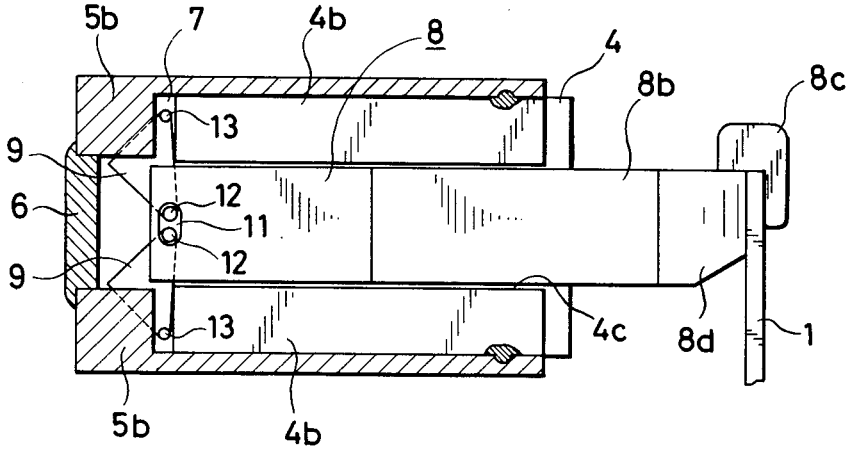
FIG. 5 is a section view taken along the line IV—IV in FIG. 1, with the shutters opened.
Figure 6:
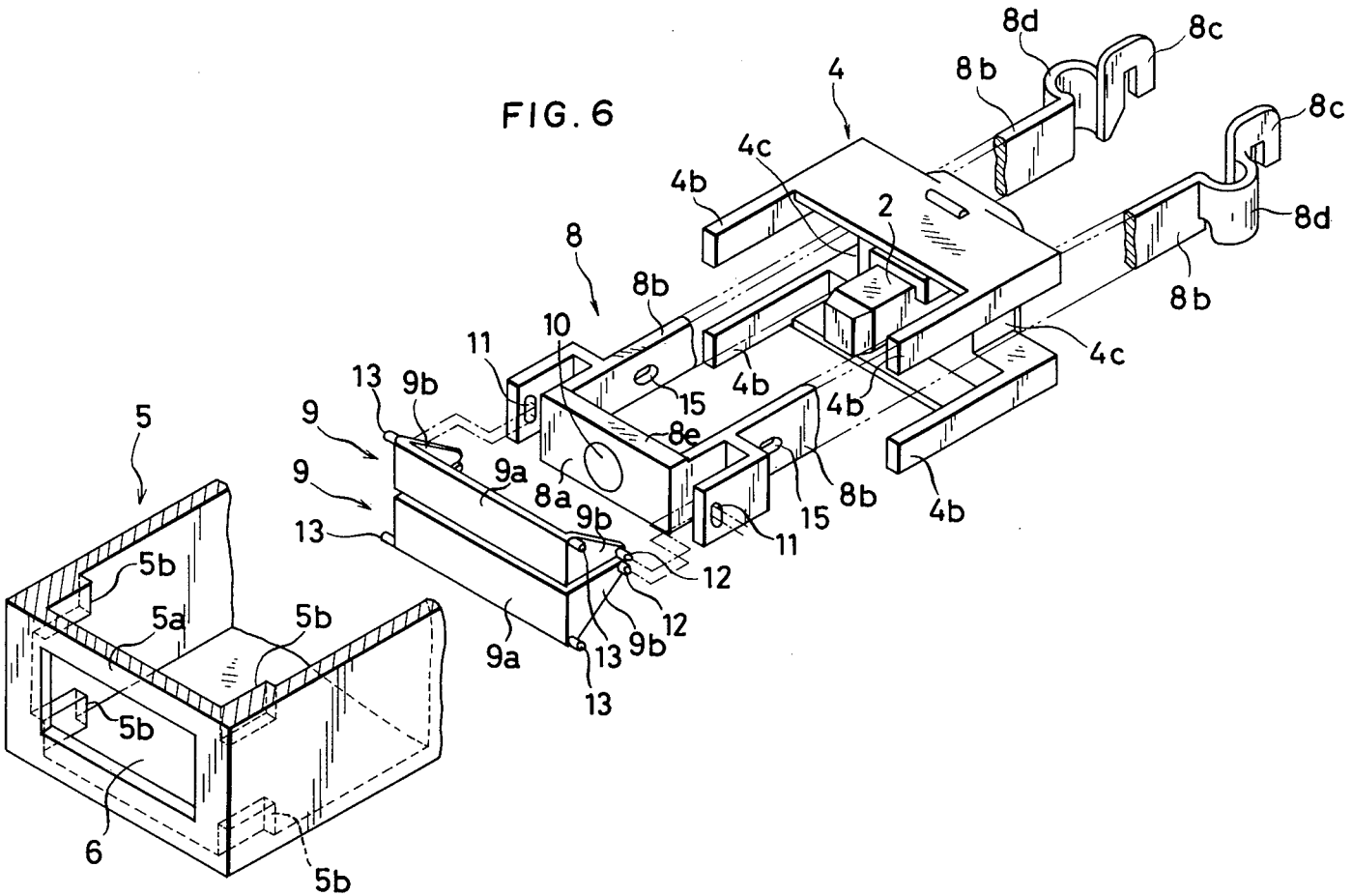
FIG. 6 is a disassembled perspective view of the component parts of a push button switch assembly.

When the operational rod 2 is forwardly projected, the guide grooves 7 are located in a forward position with respect to the pivoted portions of the shutters 9 as shown in FIG. 4 and the driven pins 13 are forwardly guided. The shutters 9 are therefore closed and there appears on the display window 6 an indication that the automatic brightness control circuit is OFF.

When the push button 3 is then pressed from this state to push the operational rod 2 in the inner direction toward the frame 1, the guide grooves 7 of the push button 3 are moved rearwardly with respect to the shutter pivoted portions of the support 8 substantially immovable, i.e., the slots 11. The driven pins 13 of the shutters 9 are therefore slidably moved rearwardly in the guide grooves 7, thereby to open the shutters 9. When the operational rod 2 is locked at its pressed position, the shutters 9 are fully opened as shown in FIG. 4 and the photo-register 10 disposed at the display surface 8*a* of the display plate 8*e* is exposed to the outside through the display window 6, simultaneously with that the automatic brightness control circuit is turned ON.

As discussed hereinbefore, the shutters 9 may be opened or closed responsively to the pressed or projected position of the push button 3. In the display device according to the present invention, the springs 8*d* are disposed at the leg members 8*b* of the support 8 such that the support 8 be supported in an elastically movable manner in the pressed/projected direction of the push button 3. Accordingly, even if the operational rod 2 for supporting the push button 3 may not always be projected by a predetermined amount, it is possible to reduce, to a great extent or substantially to zero, the rate of producing defective devices, i.e., products having the shutters which may not fully be closed. Namely, the dimensions of the component parts are being set so that, when the operational rod 2 is forwardly projected by a predetermined amount, the support 8 is pulled forwardly through the shutters 9 and elastically moved forwardly by a predetermined amount by means of the stretch of the springs 8*d*.

With such arrangement, even if the operational rod 2 is not projected as much as a predetermined amount and the support 8 is completely immovable so that the shutters 9 are half-opened, the support 8 may pull rearwardly the pivoted points of the shutters 9, i.e., the pins 12 by means of the return force of the springs 8*d*, whereby the shutters 9 are completely closed.

It is a matter of course that the shutter opening/closing means is not limited to one discussed in the embodiment above-mentioned, but there may be used in the present invention any means adapted to open or close the shutters responsively to the depressed/projected position of the push button with respect to the support, by guiding the pivoted ends of the shutters by means of the guide grooves of the push button.

It is also understood that the shape of the springs is not limited to one shown in the embodiment above-mentioned, but other shaped springs may also be used. However, if the springs are formed in the loop shape as shown hereinbefore, the leg members of synthetic resin may easily be formed with excellent strength. Furthermore, when the photo-register 10 or the like as mentioned earlier is attached to the display unit, such springs may also serve advantageously as guides for the lead wires 10*a*.

Although the description has been made of the embodiment where the display plate is formed integrally with the support, the display plate may be disposed, for example, at the front of the button inner body. However, the construction in which the display plate is formed integrally with the support may provide an advantage that the display surface of the display plate can be brought close to the window of the push button when the shutters are opened.

What is claimed is:

1. A display device for a push button assembly comprising:

a push button having a case-shape button outer body provided in the front surface thereof with a window, a button inner body fitted into the bottom opening of said button outer body, guide grooves formed in the opposite inner lateral sides of said button outer body, and side grooves formed in both lateral sides of said button inner body;

a display plate housed in said push button with the display surface thereof faced to said window;

a support inserted into said push button with a pair of parallel leg members of said support slideably inserted into said side grooves of said button inner body, the end portions of said leg members which are extended to the outside of said push button, being securely fixed to the frame of said push button assembly; and at least one shutter rotatably connected to the portions of the support which are inserted into said push button, and adapted to be rotated with the pivoted ends of said shutter guided by said guide grooves, between a first position wherein said display surface is screened from said window and a second position wherein said display surface is exposed to said window, responsively to the axial relative movement of said push button with said support.

2. A display device for a push button assembly as set forth in claim 1, wherein a pair of shutters are disposed.

3. A display device for a push button assembly as set forth in claim 2, wherein each of said pair of shutters is formed in the jaws shape such that its lateral sides having a triangle shape project rearwardly from the both ends of its display portion adapted to cover each half portion of said display surface, and pins are disposed at the rear ends of said lateral sides thereof and driven pins are disposed at the front ends of said lateral sides thereof, and a slot is disposed at each lateral side of said support, whereby said pins of said shutters are pivoted to said slots and said driven pins of said shutters are fittingly inserted into said guide grooves.

4. A display device for a push button assembly as set forth in claim 1, wherein said button inner body of said push button is securely fixed to the operational rod of said push button assembly and said support is securely fixed to the frame of said push button assembly.

5. A display device for a push button assembly as set forth in claim 1, wherein a display plate is disposed between said leg members of said support and is formed integrally therewith.

6. A display device for a push button assembly as set forth in claim 1 or 5, wherein said leg members of said support are provided with springs expandable in the moving direction of said push button, said springs adapted to apply spring-load in the shutter closing direction, to said shutters at their closed position.

7. A display device for a push button assembly as set forth in claim 1, wherein a photo-electric converting element is disposed at said display surface.

8. A display device for a push button assembly as set forth in claim 7, wherein said photo-electric converting element is connected to an automatic brightness control circuit of a television set.

9. A display device for a push button assembly as set forth in claim 7 or 8, wherein the lead wires from said photo-electric converting element are extended to the outside of said push button along said leg members of said support and thus extended ends of said lead wires are entwined with and fixed to said springs in the loop shape disposed at said leg members of said support.

* * * * *